US006474094B2

(12) United States Patent
Kim

(10) Patent No.: US 6,474,094 B2
(45) Date of Patent: Nov. 5, 2002

(54) REFRIGERATOR HAVING FREEZER COMPARTMENT

(75) Inventor: Ik-Geun Kim, Kwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/961,416

(22) Filed: Sep. 25, 2001

(65) Prior Publication Data

US 2002/0083731 A1 Jul. 4, 2002

(30) Foreign Application Priority Data

Dec. 29, 2000 (KR) ..... 00-86189

(51) Int. Cl.[7] ..... F25D 11/02
(52) U.S. Cl. ..... 62/441; 62/312; 62/443
(58) Field of Search ..... 62/441, 440, 443, 62/446, 344, 312; 312/276, 293.2; 141/358

(56) References Cited

U.S. PATENT DOCUMENTS

| | | | | |
|---|---|---|---|---|
| 2,717,501 A | | 9/1955 | Andersson | |
| 2,968,168 A | | 1/1961 | Lippincott | |
| 3,046,754 A | | 7/1962 | Kniffin | |
| 3,208,233 A | | 9/1965 | Linstromberg | |
| 3,667,249 A | * | 6/1972 | Brown et al. | 62/312 |
| 4,142,378 A | * | 3/1979 | Bright et al. | 62/135 |
| 4,628,699 A | | 12/1986 | Mawby et al. | |
| 5,272,888 A | * | 12/1993 | Fisher et al. | 62/344 |
| 6,050,097 A | * | 4/2000 | Nelson et al. | 62/137 |

FOREIGN PATENT DOCUMENTS

| | | | | |
|---|---|---|---|---|
| GB | 2 118 700 | | 11/1983 | |
| GB | 2208917 A | * | 4/1989 | 62/344 |
| GB | 2 275 328 | | 8/1994 | |
| JP | 00113065 | | 5/1990 | |

OTHER PUBLICATIONS

European Search Report No. 01 30 7924 dated Jan. 22, 2002. Abstract for 01307924.9.

* cited by examiner

*Primary Examiner*—Denise L. Esquivel
*Assistant Examiner*—Melvin Jones
(74) *Attorney, Agent, or Firm*—Robert E. Bushnell, Esq.

(57) ABSTRACT

A refrigerator having a freezer compartment enabling a storage space of the freezer compartment to be efficiently utilized by improving the structure of an automatic ice-making system is disclosed. The freezer compartment is divided into a first section for an automatic ice-making system and a second section for storing foodstuffs. The ice-making system includes an automatic ice-maker set in the first section to form ice cubes, an ice cube container installed under the ice-maker to receive ice cubes from the automatic ice-maker and having a width larger than that of the ice-maker but smaller than that of the freezer compartment, and a hose for supplying water to the ice-maker. The hose penetrates the top wall of the freezer compartment to preferably reduce the height of the ice-maker. A length of the ice cube container is larger than its width. Due to the reduced width of the ice cube container, a quick cooling chamber, in addition to an automatic ice-making chamber for the ice-making system, is defined in the first section. The quick cooling chamber contains a vertical partition wall for separating the ice-making chamber from the quick cooling chamber, and an openable cover plate for closing or opening the front opening of the quick cooling chamber.

36 Claims, 6 Drawing Sheets

REFRIGERATOR HAVING FREEZER COMPARTMENT

CLAIM OF PRIORITY

This application makes reference to, incorporates the same herein, and claims all benefits accruing under 35 U.S.C. §119 from my application entitled REFRIGERATOR HAVING FREEZING COMPARTMENT filed with the Korean Industrial Property Office on Dec. 29, 2000 and there duly assigned Ser. No. 2000-86189.

BACKGROUND OF THE INVENTION

1. Field of the Invention

The present invention relates in general to refrigerators and, more particularly, to a refrigerator having a freezer compartment with an automatic ice-making system improved in its structure to accomplish efficient utilization of the storage space of the freezer compartment.

2. Description of the Prior Art

In general, refrigerators are appliances that feed cool air generated from an evaporator into both a freezer compartment and a refrigerator compartment to maintain freshness of various foodstuffs stored in the two compartments. The freezer compartment typically stores foodstuffs to be maintained at a temperature of not higher than the freezing point, for example frozen meat, frozen fishes or the like, while the refrigerator compartment typically stores foodstuffs to be freshly maintained at a temperature of not lower than the freezing point, for example vegetables, fruits, beverages or the like.

The freezer compartment of a conventional large-sized refrigerator is typically provided with an automatic ice-making system comprising an automatic ice-maker for freezing fresh water to form ice cubes, an ice cube container for storing the ice cubes formed by the ice-maker, and an ice cube dispensing unit for dispensing the ice cubes from the container to the outside of the refrigerator. Therefore, when it is desired to use ice cubes, a user easily discharges ice cubes from the container through an ice cube discharge opening of a freezer compartment door without opening the door of the freezer compartment.

FIG. 1 shows a conventional freezer compartment equipped with such an automatic ice-making system.

The freezer compartment 11 is defined by a housing 10 having a top wall, a bottom wall and sidewalls. A front access opening of the freezer compartment 11 is provided with a freezer compartment door 12 for closing or opening the compartment 11. The above freezer compartment 11 is also provided at its rear wall with an evaporator 13 for generating cool air, and at its bottom wall with a compressor 14.

An automatic ice-making system 20 is installed inside the upper portion of the freezer compartment 11. This ice-making system 20 comprises an automatic ice-maker 21, an ice cube container 22 and an ice cube dispensing unit 23. The ice-maker 21 receives water from an external water supply (not shown) through a water supply hose 19 and forms ice cubes. The ice cube container 22 is provided at a position under the ice-maker 21 to store the ice cubes formed by the ice-maker 21, and the ice cube dispensing unit 23 is provided within the ice cube container 22 and discharges ice cubes from the container 22 to the outside of the refrigerator when a user operates the dispensing unit 23.

The freezer compartment 11 is also provided with a plurality of shelves 15 and storage boxes 16 at predetermined positions under the ice-making system 20 for holding frozen foodstuffs in the compartment 11.

The automatic ice-making system 20, provided at the upper portion inside the freezer compartment 11, must be designed to dispense ice cubes from the ice cube container 22 to the outside of the freezer compartment 11 without forcing a user to open the freezer compartment door 12. To this end, the freezer compartment door 12 is provided with an ice cube discharge conduit 24 for allowing ice cubes from the container 22 to pass therethrough, and is provided at its outer surface with a recessed station 25 for receiving the ice cubes discharged from the conduit 24. The recessed station 25 is provided with a switch lever 26 for activating the ice cube dispensing unit 23. Therefore, when a user pushes backward the switch lever 26 with a cup 100, the ice cube dispensing unit 23 is activated to dispense ice cubes from the container 22 into the cup 100. That is, water supplied from the outside is frozen by the ice-maker 21 to form ice cubes, and then the ice cubes are automatically fed into the ice cube container 22. When the ice cube dispensing unit 23 is activated by a user, the ice cubes in the container 22 are discharged from the container 22 to the recessed station 25 through the discharge conduit 24.

However, as shown in FIGS. 2 and 3, since the conventional ice cube container 22 set in the upper portion of the freezer compartment 11 has a width approximately equal to the width of the freezer compartment 11, the storage space of the freezer compartment 11 is not efficiently utilized. That is, the automatic ice-maker 21 has a relatively small width, and so it only occupies a portion of the freezer compartment 11 at a position around a sidewall of the compartment 11. However, the ice cube container 22 installed under the automatic ice-maker 21 occupies approximately the whole width of the storage chamber of the freezer compartment 11. An dead space D1 is thus left between the ice-maker 21 and the opposite sidewall of the compartment 11 at a position above the ice cube container 22. It is impossible for ice cubes from the ice-maker 21 to be stored in that space D1, and SO the space D1 is a useless space.

In the conventional ice-making system 20, the width W1 of the ice cube container 22 is designed to be larger than the width W2 of the ice-maker 21 so as to store a sufficient amount of ice cubes in the container 22. However, such a difference between the two widths W1 and W2 undesirably leaves dead spaces (D2) outside the opposite sides of the container's bottom wall. That is, since the ice cube dispensing unit 23 is longitudinally and centrally arranged inside the ice cube container 22, the ice cubes stored inside the opposite sides of the container's bottom wall cannot be effectively or smoothly fed to the dispensing unit 23 if the container 22 has a flat bottom wall meeting the sidewall at a right angle. Therefore, it is necessary to bulge the container's bottom wall to naturally guide the ice cubes by gravity from the opposite sides of the bottom wall to the ice cube dispensing unit 23. However, the bulged shape of the container's bottom wall undesirably leaves the dead spaces D2 outside the opposite sides of the container's bottom wall as best seen in FIG. 2. In addition, since the automatic ice-maker 21 is arranged above the ice cube container 22 at a position eccentric from the central axis of the container 22 as shown in FIG. 2, the ice cubes from the automatic ice-maker 21 are accumulated to their maximum height at a position inside the container 22 just under the ice-maker 21. However, the height of the accumulated ice cubes is gradually lowered in a direction from the maximum height toward the side of the container 22 remote from the ice-maker 21 while leaving another dead space D3 within the container 22.

Furthermore, a water supply hose 19 for supplying water to the automatic ice-maker 21 extends through the sidewall of the freezer compartment 11 to reach the interior of the compartment 11 at its inside end. The inside end of the hose 19 also penetrates the sidewall of the automatic ice-maker 21 and is terminated at a position above an ice-making tray 27, and so the ice-maker 21 must be inevitably increased in its height due to the position of the water supply hose 19 relative to the ice-maker 21. With the configuration of the automatic ice-maker 21, the effective storage space of the conventional freezer compartment 11 is further reduced.

Therefore, the storage space inside the freezer compartment 11 is not efficiently utilized due to the structural defect of both the ice cube container 22 having such an excessive width (W1) and the automatic ice-maker 21 having such an excessive height. In addition, the part of the interior of the freezer compartment 11, at which the automatic ice-maker 21 and the ice cube container 22 are installed, is regrettably limitedly used only for ice-making. As a result, the refrigerators having a freezer compartment with both the automatic ice-maker 21 and the ice cube container 22 are reduced in the efficiency of their storage space, thereby being reduced in their operational efficiency and being inconvenient to users.

SUMMARY OF THE INVENTION

Accordingly, the present invention has been made keeping in mind the above problems occurring in the prior art, and an object of the present invention is to provide a refrigerator, in which the automatic ice-making system inside a freezer compartment is structurally improved to preferably reduce its installation space and installation area, thus accomplishing more efficient utilization of the storage space inside the freezer compartment.

It is another object of the present invention to provide a refrigerator, in which the section of the freezer compartment with the automatic ice-making system is partitioned to separately form a quick cooling chamber.

In order to accomplish the above objects, the present invention provides a refrigerator having a freezer compartment with both a first section for seating an automatic ice-making system and a second section for storing foodstuffs, wherein the automatic ice-making system comprises an automatic ice-maker for forming ice cubes, and an ice cube container provided under the automatic ice-maker for storing ice cubes from the automatic ice-maker, the ice cube container having a width almost equal to that of the automatic ice-maker; and the first section is divided into an automatic ice-making chamber for seating the ice-making system and a quick cooling chamber defined in a space left in the first section due to a reduction in the width of the ice cube container.

The automatic ice-making system further comprises a water supply hose for supplying water to the automatic ice-maker, the water supply hose being installed while penetrating the top wall of the freezer compartment, thus allowing a reduction in the height of the automatic ice-maker.

The automatic ice-maker is arranged along the central axis of the ice cube container, with the top opening of the ice cube container broadening to allow the ice cubes from the ice-maker to be smoothly introduced into the container and evenly accumulated in the container.

In the refrigerator, the ice cube container has a length longer than its width.

The quick cooling chamber is defined by a vertical partition wall separating the automatic ice-making chamber from the quick cooling chamber, with an openable cover plate closing or opening the front opening of the quick cooling chamber.

The ice cube container is mounted at its rear end to the rear wall of the freezer compartment, and is mounted at its opposite sides to the sidewall of the freezer compartment and the vertical partition wall positioned opposite to the sidewall of the freezer compartment.

The cover plate is provided at its upper and lower portions with an upwardly protruded hinge pin and a downwardly protruded hinge pin, the vertical partition wall is provided at its upper portion with a bracket having an upper hinge hole for rotatably receiving the upwardly protruded hinge pin, and the horizontal partition wall is provided with a lower hinge hole for rotatably receiving the downwardly protruded hinge pin, whereby the cover plate is rotatably hinged to both the horizontal partition wall and the vertical partition wall such that the cover plate is rotatable around the hinge pins received in the hinge holes.

The horizontal partition wall is provided at a portion around the lower hinge hole with a recess inwardly cut away, thus allowing the cover plate to be smoothly closed or opened.

The cover plate is provided at its lower edge with a locking protrusion protruded downwardly, and the horizontal partition wall has a locking slot at a position corresponding to the locking protrusion, thus receiving the locking protrusion to maintain a closed position of the cover plate.

In the refrigerator, an elastic rib extends rearward from the front edge of the locking slot to be terminated at a free end, thus allowing a smooth operation of the cover plate when the cover plate is closed or opened.

The quick cooling chamber is provided with a shelf extending horizontally from an approximate middle portion of the vertical partition wall.

The shelf is provided at its one edge around the vertical partition wall with at least one hinge pin extending in a direction parallel to the edge of the shelf, and the vertical partition wall is provided with at least one boss having a hinge hole rotatably receiving the hinge pin of the shelf, the shelf being thus foldable in a vertical direction around the hinge pin received in the hinge hole of the boss.

In the refrigerator, a projection extends from the vertical partition wall upward at a position horizontally aligned with the boss, and a recess is formed on the shelf at a position corresponding to the projection and receives the projection, thus maintaining a hinged joint of the hinge pin of the shelf and the boss of the vertical partition wall without allowing a removal of the shelf from the vertical partition wall caused by a forward or backward movement of the shelf relative to the vertical partition wall.

In addition, a supporting bar is mounted to the vertical partition wall to support the hinged edge of the shelf, and a vertical support plate stands upright on the horizontal partition wall so as to support the free edge of the shelf when the shelf is laid horizontally.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
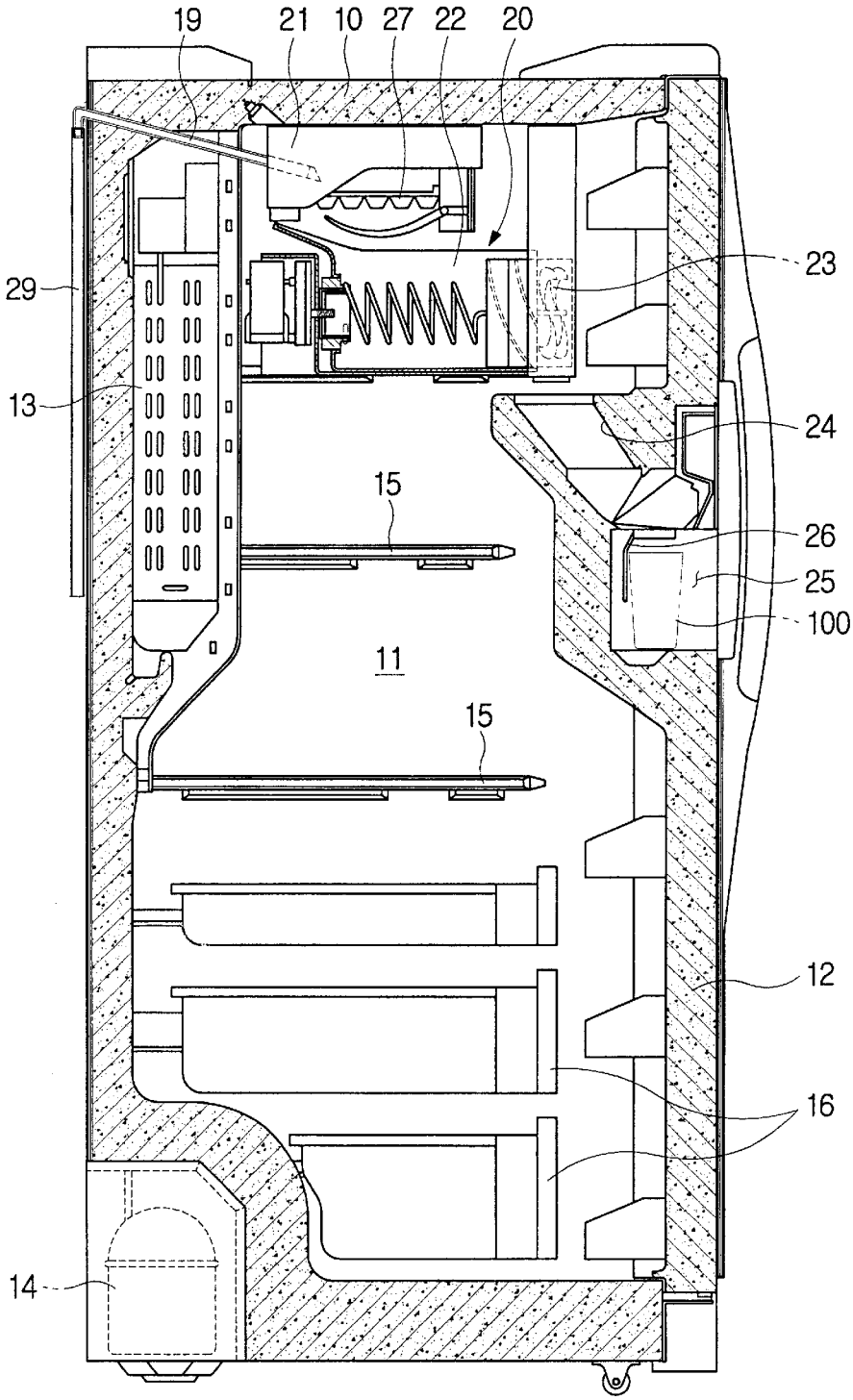
FIG. 1 (PRIOR ART)
FIG. 1 is a sectional side elevation showing the structure of a freezer compartment of a conventional refrigerator.

Reference now should be made to the drawings, in which the same reference numerals are used throughout the different drawings to designate the same or similar components.

Figure 4:
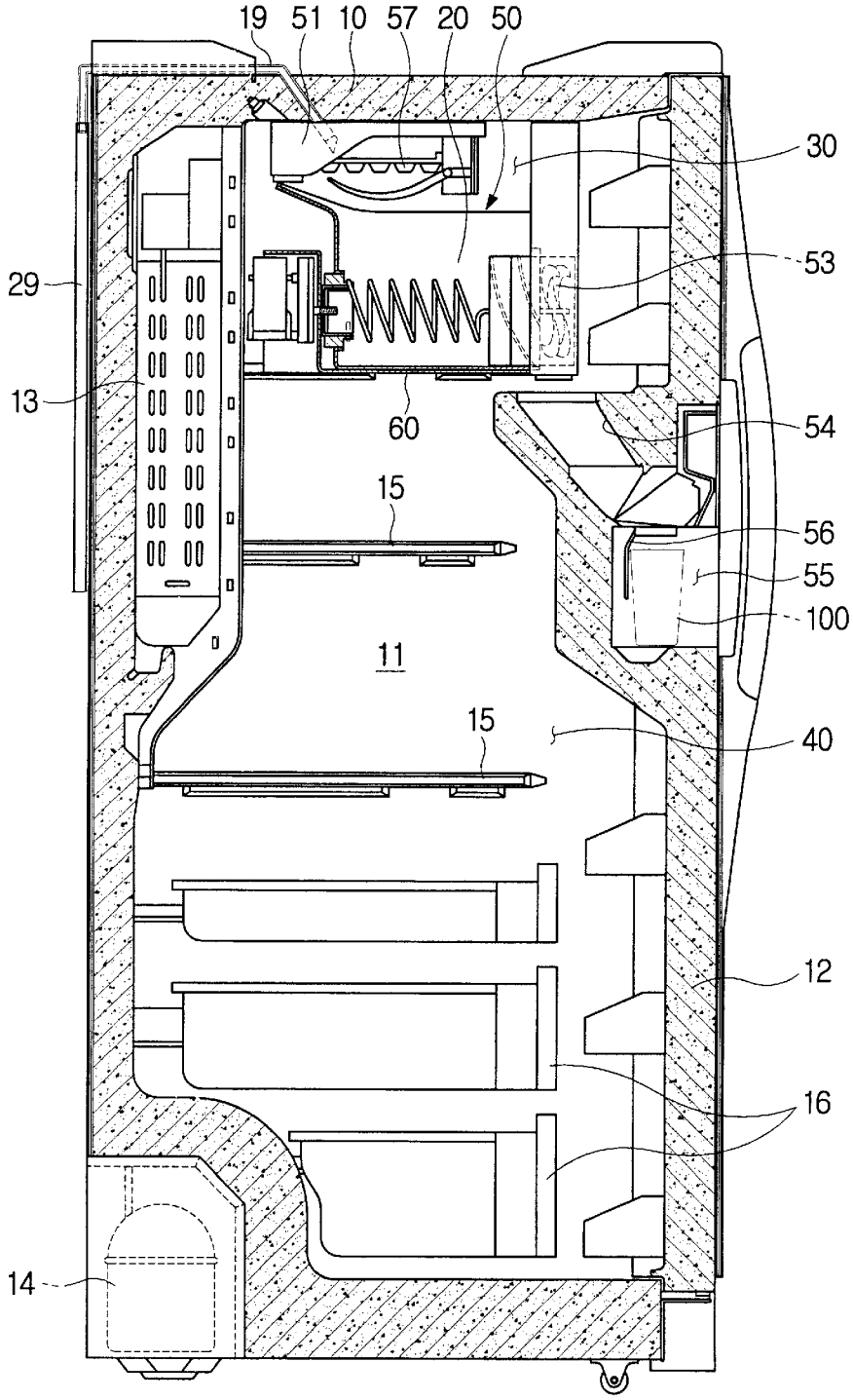
FIG. 4 is a sectional side elevation showing the structure of the freezer compartment of a refrigerator according to the invention.

FIG. 4 is a sectional side elevation showing the freezer compartment of a refrigerator according to the present invention.

As shown in the drawing, the freezer compartment 11 of the present invention has a first section 30 provided with an automatic ice-making system 50 for making and discharging ice cubes automatically, a second section 40 for storing frozen foodstuffs, and a horizontal partition wall 60 for horizontally partitioning the first section 30 from the second section 40.

The second section 40 is provided with a plurality of selves 15 and storage bins 16 for holding and storing frozen foodstuffs in the same manner as that described for the conventional freezer compartments.

Figure 5:
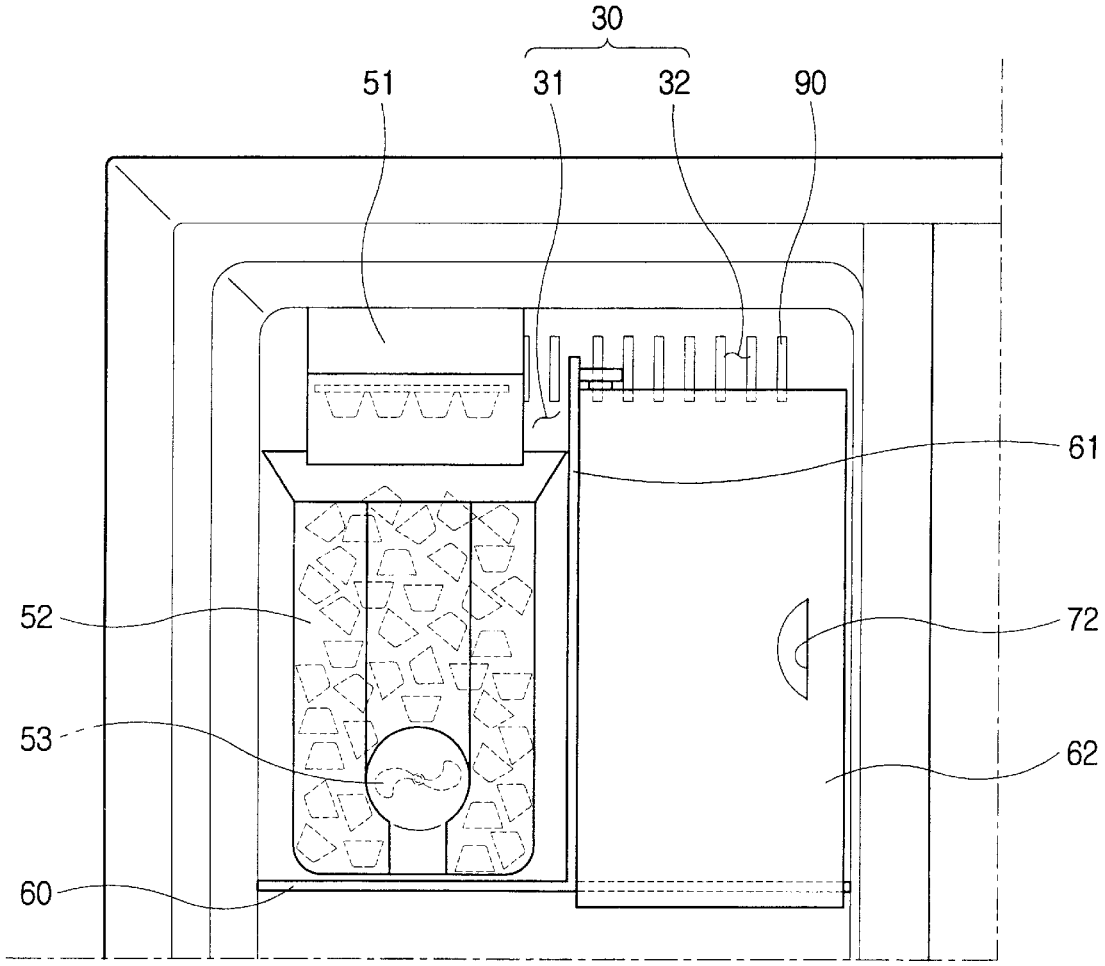
FIG. 5 is a front elevation showing the upper portion of the freezer compartment of FIG. 4, in which an automatic ice-maker is installed.

The first section 30, defining the space characterizing the present invention, is divided into an automatic ice-making chamber 31 for an automatic ice-making system 50, and a quick cooling chamber 32 positioned in parallel with the automatic ice-making chamber 31 (see FIG. 5).

The ice-making system 50 mounted in the automatic ice-making chamber 31 includes an automatic ice-maker 51 for automatically forming ice cubes from fresh water supplied from the outside through the water supply hose 19, an ice cube container 52 arranged under the automatic ice-maker 51, and an ice cube dispensing unit 54 arranged in the ice cube container 52. The ice-making system 50 further comprises an ice cube discharge conduit 54, a recessed station 55 and a switch lever 56 which are provided at a freezer compartment door.

The water supply hose 19 is connected at its outside end to a water supply pipe 29 attached to the outer surface of the refrigerator, and penetrates the top wall of the freezer compartment 11 at its inside end while extending inclinedly downward until it is terminated at a position above an ice-making tray 57. Therefore, water supplied from an external water supply flows through both the water supply pipe 29 and the water supply hose 19, and is contained in the ice-making tray 57.

When it is desired to use ice cubes, a user pushes the switch lever 56 with a cup 100 to activate the ice cube dispensing unit 53. The ice cube dispensing unit 53 is thus operated to feed ice cubes from the ice cube container 52 to the discharge conduit 54. The ice cubes are dispensed into the cup 100 set in the recessed station 55 through the discharge conduit 54.

FIG. 5 is a front elevation view showing the first section 30 of the freezer compartment 11 according to the present invention.

Figure 2:
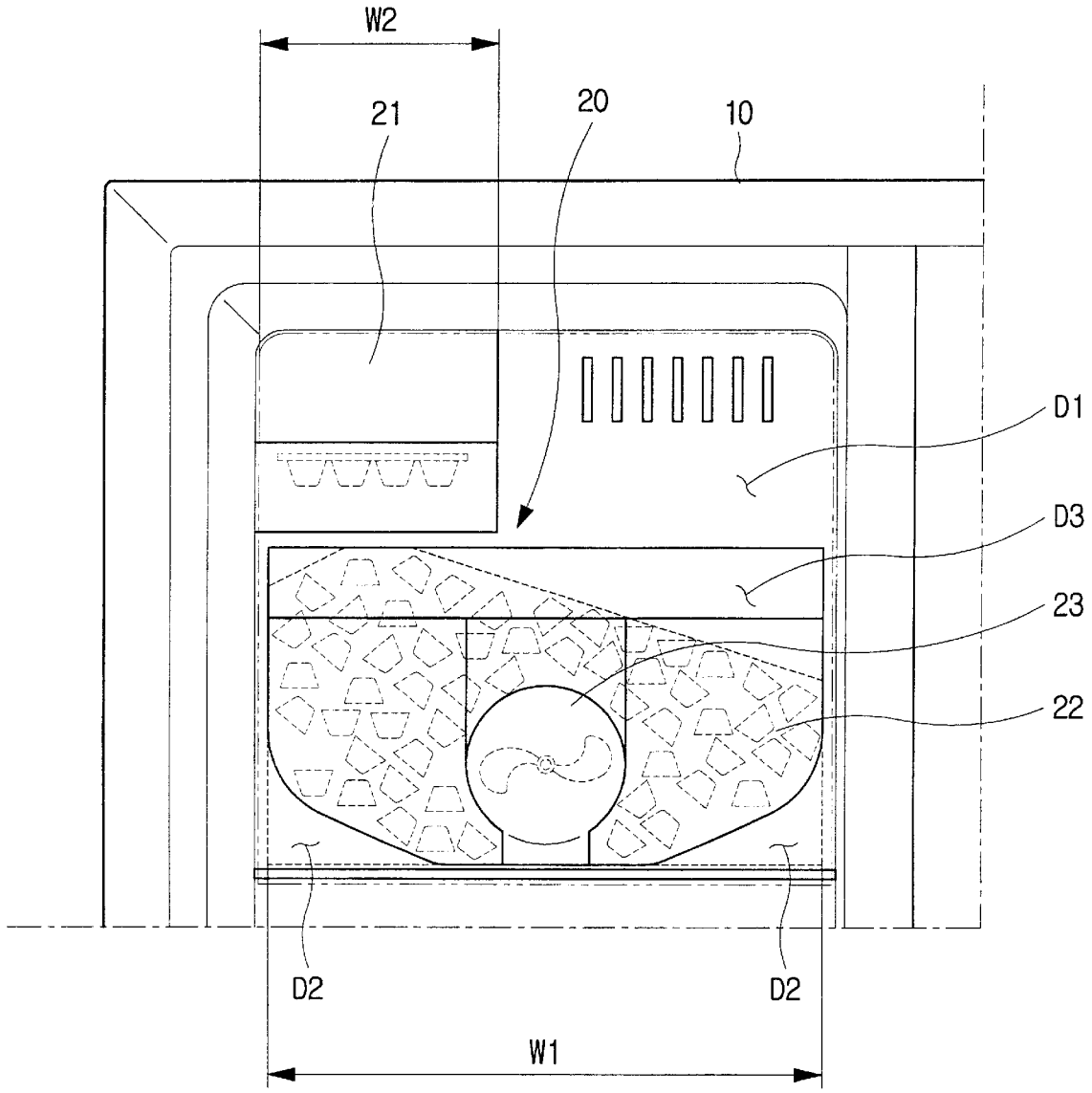
FIG. 2 (PRIOR ART)
FIG. 2 is a front elevation showing an upper portion of the freezer compartment of FIG. 1, in which an automatic ice-maker is installed.
Figure 3:
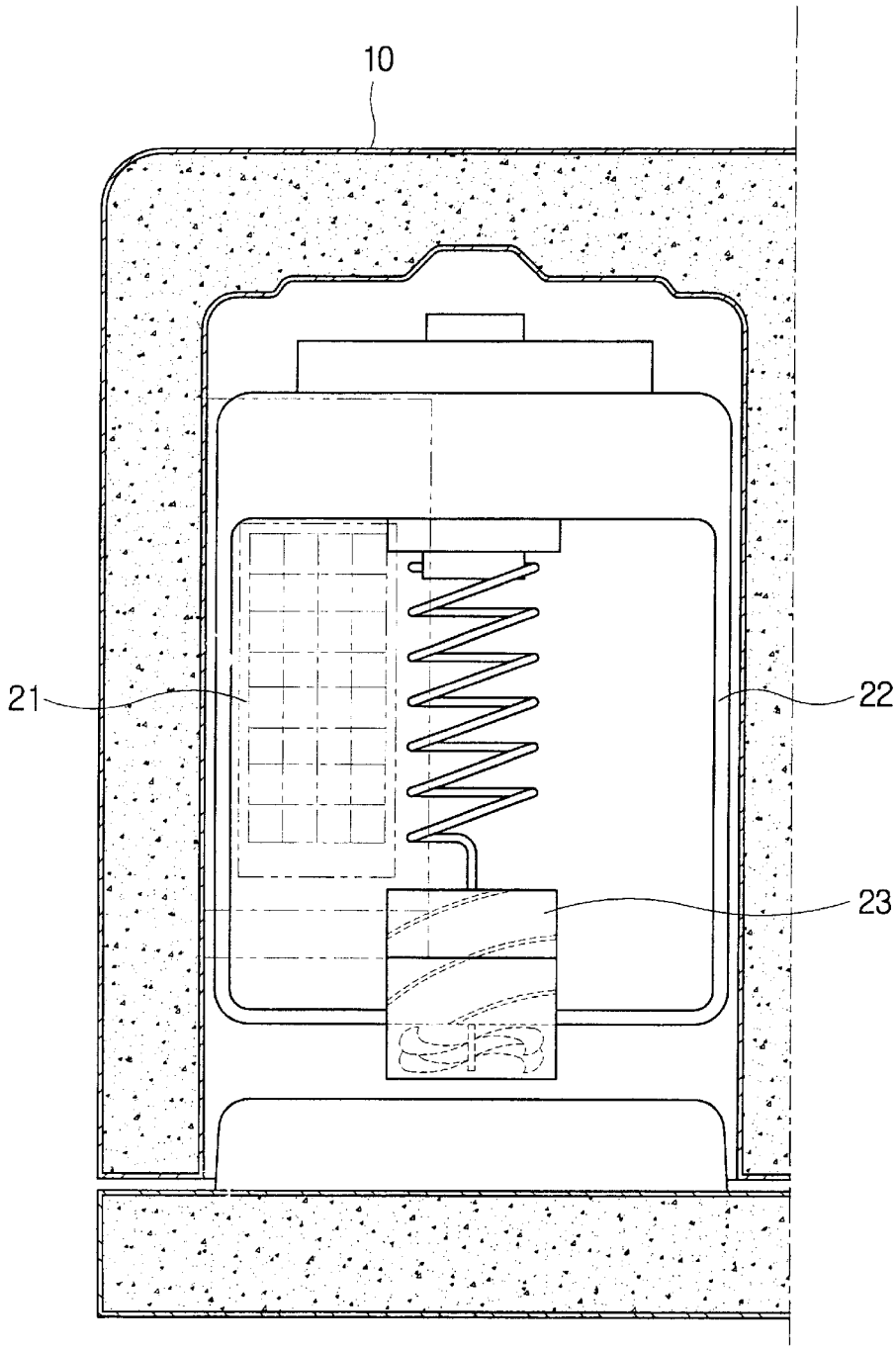
FIG. 3 (PRIOR ART)
FIG. 3 is a sectional top plan view of FIG. 2.

As shown in the drawing, the first section 30 of the freezer compartment 11 has the automatic ice-making chamber 31 and the quick cooling chamber 32 which are parallelly arranged in the section 30. Due to the division of the section 30 into the two chambers 31 and 32, it is possible to make the height of the ice-maker 51 as low as possible, different from the conventional automatic ice-makers 21 of FIG. 2. In addition, the ice cube container 52 is sized to have a width almost equal to that of the automatic ice-maker 51, with the height of the sidewall of the container 52 being increased as high as possible to form an effective volume almost equal to that of the conventional ice cube container 22 of FIG. 2.

The reduction in the height of the ice-maker 51 can be achieved by making the water supply hose 19 penetrate the top wall of the freezer compartment 11 and extend inclinedly downward as shown in FIG. 4. With such a reduction in the height of the ice-maker 51, the ice cube container 52 can be further increased in its height and further reduced in its width. Therefore, it is possible to diminish the space required to mount the automatic ice-making system 50 in the freezer compartment 11 as compared to the conventional system without causing any reduction in the effective volume of the ice cube container 52.

Referring particularly to FIG. 5, the automatic ice-maker 51 according to the present invention is centrally arranged above the ice cube container 52 with the broadening top opening of the container 52, ice cubes formed by the ice-maker 51 are symmetrically accumulated in the container 52 such that they are orderly and neatly piled up from the center position toward opposite sides of the container 52 without flowing over the sidewall of the container 52 even though the container 52 has a reduced width. Therefore, the ice cube container 52 according to the present invention almost fully contains ice cubes without leaving dead space therein, different from the conventional ice cube container 22. In addition, since the ice cube container 52 has such a reduced width, ice cubes positioned around the opposite sides of the bottom of the ice cube container 52 are effectively and smoothly fed to the ice cube dispensing unit 53 without forcing the bottom wall of the container 52 to be bulged. Therefore, the container 52 does not leave dead spaces outside the opposite sides of its bottom wall, different from the conventional container 22. Therefore, even though the ice cube container 52 of this invention is considerably reduced in its width, it has an effective volume approximately equal to that of the conventional ice cube container 22.

As mentioned above, with the improvement in the construction of the automatic ice-making system 50 of this invention, the quick cooling chamber 32 for quickly cooling foodstuffs, in addition to the automatic ice-making chamber 31 having the automatic ice-making system 50, is defined in the first section 30 of the freezer compartment 11. That is, the storage space of the freezer compartment 11 is more efficiently utilized by the provision of the quick cooling chamber 32 in the space left in the first section 30 due to the reduction in the width of the ice cube container 52.

Figure 6:
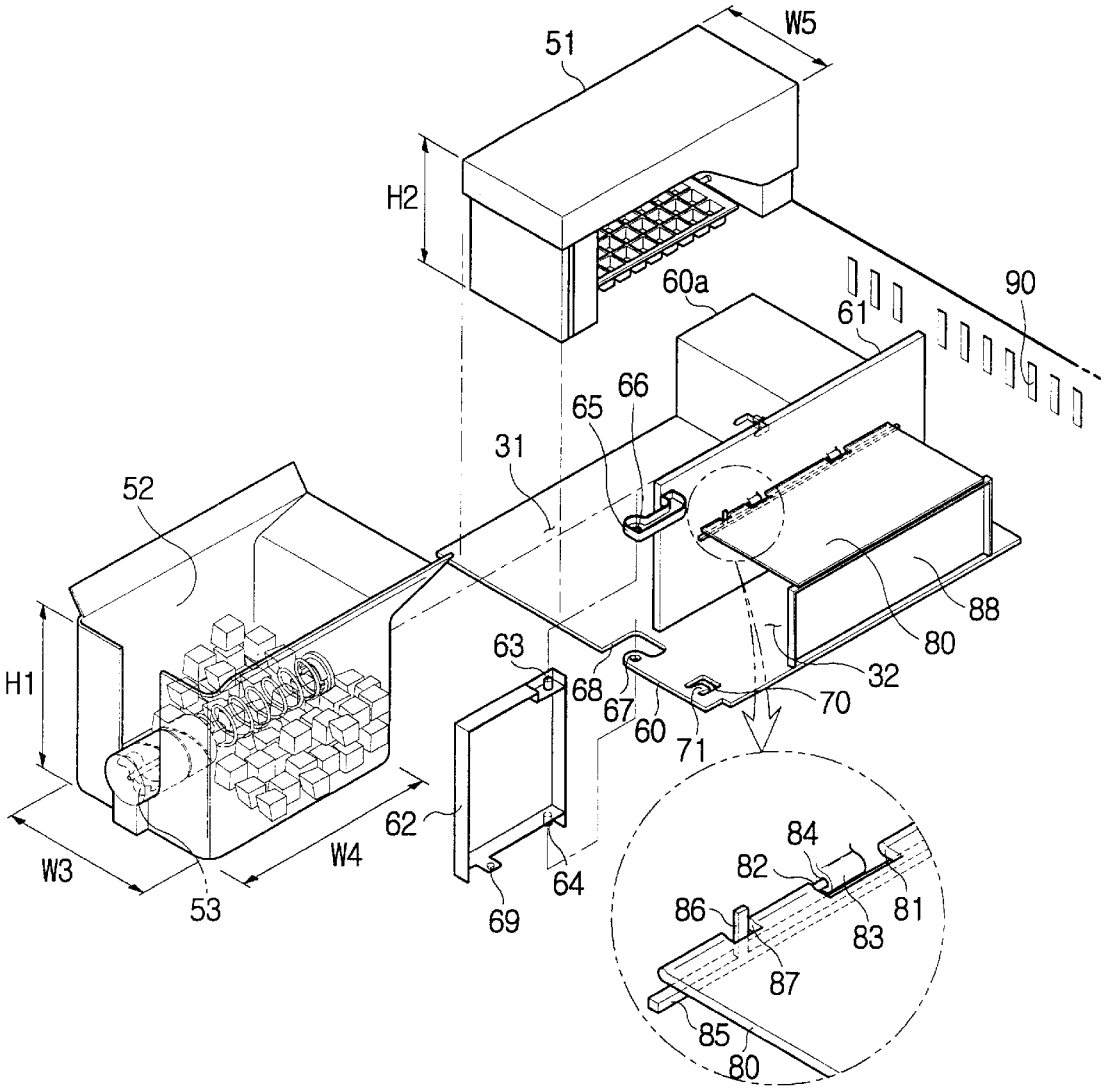
FIG. 6 is an exploded perspective view of the upper portion of the freezer compartment of FIG. 5.

FIG. 6 is a perspective view showing the internal structure of the automatic ice-making chamber 31 and the quick cooling chamber 32 defined in the first section 30.

As shown in the drawing, the automatic ice-making chamber 31 receives the automatic ice-maker 51 and the ice cube container 52, with the ice cube dispensing unit 53 arranged inside the ice cube container 52. The width W3 of the ice cube container 52 is determined to be slightly larger than the width W5 of the automatic ice-maker 51. In addition, the height H2 of the automatic ice-maker 51 is reduced by changing the position of the water supply hose 19 inside the freezer compartment 11 as shown in FIG. 4, and so it is possible to increase the height Hi of the ice cube container 52 by the reduced height H2 of the ice-maker 51. The width W3 of the ice cube container 52 is considerably smaller than the length W4.

The quick cooling chamber 32 is defined in the first section 30 by the horizontal partition wall 60, a vertical partition wall 61 and an openable cover plate 62. The horizontal partition wall 60 partitions the interior of the freezer compartment 11 into the first and second sections 30 and 40 as described above, while the vertical partition wall 61 partitions the first section 30 into the automatic ice-making chamber 31 and the quick cooling chamber 32. The cover plate 62 is mounted to the front opening of the quick cooling chamber 32 so as to open or close the chamber 32. In the present invention, the vertical partition wall 61 may be integrated with the horizontal partition wall 60 into a single structure without affecting the functioning of this invention. The horizontal partition wall 60 in the automatic ice-making chamber 31 is bent two times at its rear portion 60a to form a stepped shape defining a motor chamber under the stepped portion, with a motor (not shown) for the ice cube dispensing unit 53 installed in the motor chamber.

The ice cube container 52 is fixedly attached at its rear end to the rear wall of the freezer compartment 11, and is also fixedly attached at its opposite sides to the sidewall of the freezer compartment 11 and the vertical partition wall 61, respectively.

For enabling the cover plate 62 to be rotatably attached to the front edge of the vertical partition wall 61, the cover plate 62 is provided at upper and lower portions of one side thereof with an upward protruded hinge pin 63 and a downward protruded hinge pin 64, respectively. The vertical partition wall 61 is provided at its upper portion with a bracket 65 having an upper hinge hole 66, while the horizontal partition wall 60 is formed at its front edge with a lower hinge hole 67. Therefore, the cover plate 62 is hinged to both the horizontal partition wall 60 and the vertical partition wall 61, with the upper hinge pin 63 inserted into the upper hinge hole 66 of the bracket 65 and the lower hinge pin 64 inserted into the lower hinge hole 67 of the horizontal partition wall 60. The cover plate 62 is thus rotatable to close or open the quick cooling chamber 32. The horizontal partition wall 60 is also provided at a portion around the hinge hole 67 with a recess 68 inwardly cut away, and so the cover plate 62 is inserted at its portion adjacent to the lower hinge pin 64 into the recess 68, thus being smoothly closed and opened.

For securely maintaining the closed position of the cover plate 62, the cover plate 62 is provided at its lower edge with a locking protrusion 69 protruded downwardly, while the horizontal partition wall 60 has a locking slot 70 at a position corresponding to the protrusion 69 when the cover plate 62 is fully closed. An elastic rib 71 integrally extends rearward from the front edge of the locking slot 70 to be terminated at a free end. Hence, when the cover plate 62 is closed, the locking protrusion 69 of the cover plate 62 is primarily laid on the elastic rib 71 of the locking slot 70 and is secondarily moved backward while biasing the rib 71 downward until the cover plate 62 reaches its closed position inside the slot 70. When the cover plate 62 is opened, the locking protrusion 69 escapes from the slot 70 while biasing the elastic rib 71 downward until the protrusion 69 is fully removed from the rib 71. The cover plate 62 is provided at its front surface with a pull cut portion 72 (see FIG. 5) to allow the cover plate 62 to be easily opened.

The quick cooling chamber 32 is provided therein with a folding shelf 80 enabling the chamber 32 to be more efficiently utilized. The above shelf 80 is hinged to the approximate middle portion of the vertical partition wall 61. In order to hinge the shelf 80 to the vertical partition wall 61, the shelf 80 is provided at its one edge with a plurality of recesses 81, with a plurality of hinge pins 82 each extending from one edge of each recess 81 in a direction parallel to the edge of the shelf 80. The vertical partition wall 61 is provided at positions along a horizontal line corresponding to the hinge pins 82 with bosses 83 each having a hinge hole 84. Therefore, the folding shelf 80 is detachably hinged to the vertical partition wall 61 by inserting the hinge pins 82 into the hinge holes 84 of the bosses 83.

For secondarily supporting the hinged edge of the shelf 80 on the vertical partition wall 61, a linear supporting bar 85 is attached to the vertical partition wall 61 at a level under the bosses 83. The linear supporting bar 85 is provided with a plurality of elastic projections 86 extending from the supporting bar 85 upward to restrict a horizontal movement of the shelf 80 along the surface of the vertical partition wall 61 and prevent the shelf 80 from being unexpectedly removed from the vertical partition wall 61. At positions corresponding to the elastic projections 86, the shelf 80 has a plurality of small recesses 87 having a predetermined width and receives the projections 86 in the small recesses 87. Therefore, when the shelf 80 is hinged to the bosses 83, the bosses 83 are primarily seated into the recesses 81 with the elastic projections 86 elastically biased forward. Thereafter; the hinge pins 82 are inserted into the hinge holes 84 of the bosses 83, while the projections 86 are elastically returned to their original upright positions inside the small recesses 87. Due to the engagement of the projections 86 and the small recesses 87, the hinged joint of the shelf 80 relative to the vertical partition wall 61 is reliably maintained without allowing a forward or backward movement of the shelf 80 relative to the vertical partition wall 61.

In order to support the free end of the shelf 80 when the shelf 80 is laid horizontally, a vertical support plate 88 stands upright on the horizontal partition wall 60 while extending in parallel to the vertical partition wall 61. Therefore, when the shelf 80 is horizontally laid so as to store a large number of compact foodstuffs inside the chamber 32, the hinged edge of the shelf 80 is supported on the supporting bar 85 of the vertical partition wall 61 with the free end of the shelf 80 supported on the top edge of the vertical support plate 88 of the horizontal partition wall 60. In such a case, the quick cooling chamber 32 is partitioned into upper and lower sections by the shelf 80, thus storing more foodstuffs. However when it is desired to store relatively large foodstuffs inside the quick cooling chamber 32, the shelf 80 is fully folded upward to come into surface contact with the vertical partition wall 61.

The rear wall, defining the rear end of the quick cooling chamber 32, has a plurality of cool air-discharging ports 90 for quickly cooling the foodstuffs stored in the chamber 32. Since the vertical partition wall 61 has a height lower than the overall height of the first section 30, the automatic ice-making chamber 31 communicates with the quick cooling chamber 32 through an opening defined above the vertical partition wall 61. Therefore, cool air discharged from the cool air-discharging ports 90 freely circulates between the automatic ice-making chamber 31 and the quick cooling chamber 32.

In the above-described embodiment according to the present invention, the space newly left in the freezer compartment due to the improvement in the structure of the automatic ice-making chamber 50 is used as the quick cooling chamber 32 for quickly cooling foodstuffs. However, it should be understood that the surplus space may be preferably used for another application without affecting the functioning of this invention.

As described above, the present invention provides a refrigerator having a freezer compartment with an automatic ice-making system. In the ice-making system of this invention, the automatic ice-maker has a reduced height to allow a desired increase in the height of an ice cube container seated under the ice-maker, and allow the width of the ice cube container to be reduced to a level slightly larger than that of the ice-maker. Due to the structural improvement of the ice-making system, the invention has advantages in that it is possible to accomplish the compactness of the automatic ice-making system without reducing the effective volume of the ice cube container in comparison with a conventional ice cube container.

Furthermore, another advantage of the invention resides in that such a reduction in the width of the ice cube container desirably leaves a surplus storage space inside the freezer compartment. When the surplus storage space is used as a quick cooling chamber as disclosed in the preferred embodiment of the present invention, it is possible for a user to quickly cool desired foodstuffs in a short period of time when necessary. Of course, it is also possible to increase the storage space of the freezer compartment by using the quick cooling chamber for storing frozen foodstuffs during a normal operation of the refrigerator.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A refrigerator having a freezer compartment with both a first section for seating an automatic ice-making system and a second section for storing foodstuffs, wherein said automatic ice-making system comprises an automatic ice-maker fixed to a top wall of the freezer compartment for forming ice cubes, and an ice cube container provided under said automatic ice-maker for storing ice cubes from the automatic ice-maker, said ice cube container having a width approximately equal to a width of the automatic ice-maker;

said first section is divided into an automatic ice-making chamber for seating the ice-making system and a quick cooling chamber for quickly cooling items stored therein;

a horizontal partition wall separating said first section from said second section; and a vertical partition wall disposed between said automatic ice-making chamber and said quick cooling chamber, a lower end of said vertical partition wall being fixed to said horizontal partition wall and an upper end of said vertical partition wall extending toward the top wall of the freezer compartment.

2. The refrigerator as set forth in claim 1, wherein said automatic ice-making system further comprises a water supply hose for supplying water to said automatic ice-maker, said water supply hose being penetratively installed through said top wall of the freezer compartment, thus allowing a reduction in a height of the automatic ice-maker.

3. The refrigerator as set forth in claim 1, wherein said automatic ice-maker is arranged along a central axis of the ice cube container, with a top opening of said ice cube container having a broader width than said automatic ice-maker to allow the ice cubes from said ice-maker to be smoothly introduced into the ice cube container and evenly accumulated in said ice cube container.

4. The refrigerator as set forth in claim 1, wherein said ice cube container has a length longer than its width.

5. The refrigerator as set forth in claim 1, wherein said quick cooling chamber comprises an openable cover plate closing or opening a front opening of said quick cooling chamber.

6. The refrigerator as set forth in claim 1, wherein said ice cube container is mounted at its rear end to a rear wall of the freezer compartment, and is mounted at its opposite sides to a sidewall of the freezer compartment and said vertical partition wall.

7. The refrigerator as set forth in claim 5, wherein said cover plate is provided at its upper and lower portions with an upwardly protruded hinge pin and a downwardly protruded hinge pin, respectively, said vertical partition wall is provided at its upper portion with a bracket having an upper hinge hole for rotatably receiving said upwardly protruded hinge pin, and said horizontal partition wall is provided with a lower hinge hole for rotatably receiving said downwardly protruded hinge pin, whereby the cover plate is rotatably hinged to both the horizontal partition wall and the vertical partition wall such that the cover plate is rotatable around the hinge pins received in the hinge holes.

8. The refrigerator as set forth in claim 7, wherein said horizontal partition wall is provided at a portion around the lower hinge hole with a recess inwardly cut away, thus allowing the cover plate to be smoothly closed or opened.

9. The refrigerator as set forth in claim 7, wherein said cover plate is provided at its lower edge with a locking protrusion protruded downwardly, and said horizontal partition wall has a locking slot at a position corresponding to said locking protrusion, thus receiving the locking protrusion to maintain a closed position of the cover plate.

10. The refrigerator as set forth in claim 9, wherein an elastic rib extends rearward from a front edge of said locking slot to be terminated at a free end, thus allowing a smooth operation of the cover plate when the cover plate is closed or opened.

11. The refrigerator as set forth in claim 5, wherein said quick cooling chamber is provided with a shelf extending horizontally from an approximate middle portion of said vertical partition wall.

12. The refrigerator as set forth in claim 11, wherein said shelf is provided at its one edge around the vertical partition wall with at least one hinge pin extending in a direction parallel to said edge of the shelf, and said vertical partition wall is provided with at least one boss having a hinge hole rotatably receiving the hinge pin of the shelf, said shelf being thus foldable in a vertical direction around the hinge pin received in the hinge hole of the boss.

13. The refrigerator as set forth in claim 12, wherein a projection extends from said vertical partition wall upward at a position horizontally aligned with said boss, and a recess is formed on said shelf at a position corresponding to said projection and receives the projection, thus maintaining a hinged joint of the hinge pin of said shelf and the boss of said vertical partition wall without allowing a removal of the shelf from the vertical partition wall caused by a forward or backward movement of said shelf relative to the vertical partition wall.

14. The refrigerator as set forth in claim 11, wherein a supporting bar is mounted to said vertical partition wall to support the hinged edge of the shelf, and a vertical support plate stands upright on said horizontal partition wall so as to support a free edge of the shelf when the shelf is laid horizontally.

15. The refrigerator as set forth in claim 1, said freezer compartment further comprising a rear wall having cool air-discharging ports for simultaneously discharging cool air to both the automatic ice-making chamber and the quick cooling chamber.

16. A freezer compartment of a refrigerator, said freezer compartment comprising:

a first section for seating an automatic ice-making system and a second section for storing foodstuffs, wherein said automatic ice-making system comprises an automatic ice-maker fixed to a top wall of the freezer compartment, and an ice cube container provided beneath said automatic ice-maker to catch ice cubes discharged from the automatic ice-maker, said ice cube container having a width approximately equal to a width of the automatic ice-maker;

said first section being divided into an automatic ice-making chamber for seating the ice-making system and a quick cooling chamber for quickly cooling items stored therein; and a rear wall of said freezer compartment having cool air-discharging ports for simultaneously discharging cool air to both the automatic ice-making chamber and the quick cooling chamber.

17. The freezer as set forth in claim 16, further comprising:

a horizontal partition wall separating said first section from said second section; and a vertical partition wall disposed between said automatic ice-making chamber and said quick cooling chamber, a lower end of said vertical partition wall being fixed to said horizontal partition wall and an upper end of said vertical partition wall stopping short of said top wall of the freezer compartment.

18. The freezer as set forth in claim 17, further comprising a foldable shelf attached to said vertical partition wall within said quick cooling chamber.

19. The freezer as set forth in claim 18, further comprising a support shelf for supporting a free end of said foldable shelf.

20. The freezer as set forth in claim 18, further comprising:

at least one hinge pin extending from one end of said foldable shelf;

at least one boss extending from a sidewall of said vertical partition wall for rotatably receiving said hinge pin.

21. The freezer as set forth in claim 20, further comprising:

a horizontal bar attached to said vertical partition wall below said boss for supporting said one end of said foldable shelf; and a projection extending vertically from said horizontal bar for restricting lateral movement of said foldable shelf to prevent said hinge pin from disengaging from said boss.

22. The freezer as set forth in claim 17, further comprising:

a cover plate covering said quick cooling chamber, said cover plate being hinged to both the horizontal partition wall and the vertical partition wall, said cover plate being operable between a closed position and an open position.

23. The freezer as set forth in claim 22, further comprising:

a first hinge pin extending upwards from a top edge of said cover plate;

a second hinge pin extending downwards from a bottom edge of said cover plate;

a bracket extending horizontally from said vertical partition wall, said bracket including a hinge pin through hole for receiving said first hinge pin; and a hinge pin through hole disposed within said horizontal partition wall for receiving said second hinge pin.

24. The freezer as set forth in claim 23, further comprising:

a recess in said horizontal partition wall for receiving a portion of one side edge of said cover plate, said recess and said bracket being formed to permit said cover plate to be opened;

a notch formed in a comer of said horizontal partition wall for receiving an opposite side edge of said cover plate when said cover plate is in said closed position; and a lock slot including a elastic rib formed in said horizontal partition wall adjacent said notch for receiving a locking protrusion extending downwardly from said bottom edge of said cover plate, said elastic rib being biased by said locking protrusion when said cover plate is moved said closed position.

25. A freezer compartment of a refrigerator, said freezer compartment comprising:

a first section for seating an automatic ice-making system and a second section for storing foodstuffs, wherein said automatic ice-making system comprises an automatic ice-maker fixed to a top wall of the freezer compartment, and an ice cube container provided beneath said automatic ice-maker to catch ice cubes discharged from the automatic ice-maker; and a vertical partition wall for partitioning said first section into an automatic ice-making chamber for seating the ice-making system and a quick cooling chamber for quickly cooling items stored therein, said vertical partition wall having a vertical height which permits cool air to freely circulate between the automatic ice-making chamber and the quick cooling chamber.

26. The freezer as set forth in claim 25, further comprising:

a rear wall of said freezer compartment having cool air-discharging ports for simultaneously discharging the cool air to both the automatic ice-making chamber and the quick cooling chamber.

27. The freezer as set forth in claim 25, further comprising a foldable shelf attached to said vertical partition wall within said quick cooling chamber.

28. The freezer as set forth in claim 27, further comprising a support shelf for supporting a free end of said foldable shelf.

29. The freezer as set forth in claim 25, further comprising:

a horizontal partition wall separating said first section from said second section, a lower end of said vertical partition wall being fixed to said horizontal partition wall.

30. The freezer as set forth in claim 29, further comprising a foldable shelf attached to said vertical partition wall within said quick cooling chamber.

31. The freezer as set forth in claim 30, further comprising a vertical support wall fixed to said horizontal partition wall for supporting a free end of said foldable shelf.

32. The freezer as set forth in claim 31, further comprising:

at least one hinge pin extending from one end of said foldable shelf;

at least one boss extending from a sidewall of said vertical partition wall for rotatably receiving said hinge pin.

33. The freezer as set forth in claim 32, further comprising:

a horizontal bar attached to said vertical partition wall below said boss for supporting said one end of said foldable shelf; and a projection extending vertically from said horizontal bar for restricting lateral movement of said foldable shelf to prevent said hinge pin from disengaging from said boss.

34. The freezer as set forth in claim 29, further comprising:

a cover plate covering said quick cooling chamber, said cover plate being hinged to both the horizontal partition wall and the vertical partition wall, said cover plate being operable between a closed position and an open position.

35. The freezer as set forth in claim 34, further comprising:

a first hinge pin extending upwards from a top edge of said cover plate;

a second hinge pin extending downwards from a bottom edge of said cover plate;

a bracket extending horizontally from said vertical partition wall, said bracket including a hinge pin through hole for receiving said first hinge pin; and a hinge pin through hole disposed within said horizontal partition wall for receiving said second hinge pin.

36. The freezer as set forth in claim 35, further comprising:

a recess in said horizontal partition wall for receiving a portion of one side edge of said cover plate, said recess and said bracket being formed to permit said cover plate to be opened;

a notch formed in a corner of said horizontal partition wall for receiving an opposite side edge of said cover plate when said cover plate is in said closed position; and a lock slot including a elastic rib formed in said horizontal partition wall adjacent said notch for receiving a locking protrusion extending downwardly from said bottom edge of said cover plate, said elastic rib being biased by said locking protrusion when said cover plate is moved said closed position.

* * * * *